US005310971A

United States Patent [19]

Vial et al.

[11] Patent Number: 5,310,971

[45] Date of Patent: May 10, 1994

[54] MOLDED CASE CIRCUIT BREAKER WITH CONTACT BRIDGE SLOWED DOWN AT THE END OF REPULSION TRAVEL

[75] Inventors: Denis Vial, Fontaine; Jean Bonfils, Seyssins; Marc Rival, Virieu sur Bourbre, all of France

[73] Assignee: Merlin Gerin, France

[21] Appl. No.: 25,112

[22] Filed: Mar. 2, 1993

[30] Foreign Application Priority Data

Mar. 13, 1992 [FR] France ..... 92 03142

[51] Int. Cl.[5] ..... H01H 1/22

[52] U.S. Cl. ..... 200/244; 200/250; 200/274; 200/288; 200/400; 335/16

[58] Field of Search ..... 200/244, 245, 247, 248, 200/249, 250, 257, 273, 274, 287, 288, 400, 402, 410, 416, 431, 445, 452, 459, 469, 401, 323, 324, 325; 335/16, 147, 195

[56] References Cited

U.S. PATENT DOCUMENTS

| | | | |
|---|---|---|---|
| 3,005,073 | 10/1961 | Reiss et al. | 335/16 |
| 4,649,247 | 3/1987 | Preuss et al. | 200/244 |
| 4,910,485 | 3/1990 | Bolongeat-Mobleu et al. | 335/195 |
| 5,030,804 | 7/1991 | Abri | 200/323 |

FOREIGN PATENT DOCUMENTS

| | | |
|---|---|---|
| 0314540 | 5/1989 | European Pat. Off. . |
| 0394922 | 10/1990 | European Pat. Off. . |
| 1232636 | 7/1958 | France . |

*Primary Examiner*—Glenn J. Barrett

*Attorney, Agent, or Firm*—Parkhurst, Wendel & Rossi

[57] ABSTRACT

The contact bridge of a molded case circuit breaker is rotatably mounted in a bar by two springs arranged symmetrically from the rotation axis. Each spring is, on the one hand, anchored to the contact bridge, and, on the other hand, anchored to a rod housed in a notch of the bar. The same springs provide contact pressure and slowing-down of opening of the contact bridge at the end of repulsion travel by electrodynamic effect. The contact bridge bears on its edge cam surfaces which, at the end of opening travel, engage the anchoring rods to move them in the notches in the elongation direction of the tension springs. The energy of the contact bridge is thus taken up and stored in the springs causing slowing-down of the contact bridge. The profile of the cams can be chosen to enable reclosing of the contact bridge, this reclosing naturally being delayed by the slowing-down effect at the end of travel. The cam profile can also ensure latching of the contact bridge in the open position.

10 Claims, 5 Drawing Sheets

MOLDED CASE CIRCUIT BREAKER WITH CONTACT BRIDGE SLOWED DOWN AT THE END OF REPULSION TRAVEL

BACKGROUND OF THE INVENTION

The invention relates to a molded case low voltage circuit breaker comprising a rotary contact bridge, a pair of stationary contacts cooperating with the contact bridge, current input conductors to the stationary contacts arranged to generate electrodynamic forces repelling the contact bridge to a repelled open position when a short-circuit occurs, a rotary bar having a transverse orifice housing with clearance the contact bridge which protrudes out from both sides of the bar, at least one pair of tension springs fitted between the bar and the contact bridge to provide a contact pressure of the contact bridge on the stationary contacts in closed position of the circuit breaker, while allowing rotation of the contact bridge to the repelled open position due to the electrodynamic forces.

In a limiting circuit breaker of the kind mentioned, the contact bridge opens quickly due to the action of the electrodynamic repulsion forces when a short-circuit occurs. High-speed breaking ensures current limiting, and as soon as the current is cleared, the contact bridge tends to return to the closed position. The return of the contact bridge to the closed position by the springs acting on this contact bridge is accentuated by bouncing of the contact bridge on the end of repulsion travel stop. These combined effects can cause reclosing of the contacts before confirmation of opening by the tripping mechanism, or before operation of the load-side circuit breaker in a selective device. A state-of-the-art circuit breaker comprises a latch holding the repelled contact in the open position to prevent any nuisance reclosing of the contacts. This device requires additional parts for latching and then for contact release.

The object of the present invention is to achieve a simple device for slowing down and possibly latching the movable contact bridge which does not require any additional parts.

SUMMARY OF THE INVENTION

The circuit breaker according to the invention is characterized in that the springs, arranged symmetrically on each side of the rotation axis of the contact bridge, each present one end anchored on the contact bridge and an opposite end anchored on a rod mounted in a notch of the bar and that the contact bridge has a pair of cams arranged symmetrically with respect to the rotation axis, each cam being arranged to cooperate at the end of repulsion travel of the contact bridge with one of the rods to slow down the movement of the contact bridge.

At the end of repulsion travel, the contact bridge comes up against the anchoring of a spring, which progressively yields storing the energy in the corresponding spring. The contact bridge is thus slowed down progressively and the impact on the end of travel stop is limited or canceled. The anchorings on the bar are formed by rods mounted in notches allowing a limited movement of the rod in the elongation direction of the corresponding spring. The same springs therefore provide the contact pressure and dampening of the impact of the repelled contact bridge. According to a development of the invention, these springs also constitute the floating assembly of the contact bridge in the bar. A part of the energy from the contact bridge is also absorbed by the friction between the cam and anchoring rod. The assembly is arranged in such a way as to reduce the torque exerted by the springs on the contact bridge in the course of opening travel of the latter. In a first embodiment, the movement of the contact bridge is simply slowed down at the end of travel, and its reclosing is not prevented. The intensity of deceleration is determined by the profile of the cam and in another embodiment, this profile is such that the resistance of the forces acting on the contact bridge in the repelled position locks this contact bridge in the open position. This locking can also result from a real latching or catching, the profile of the cam having, for example, an excavation in which the anchoring rod is housed.

It is advantageous to arrange the springs on each side of the contact bride, the two conjugate springs being anchored on a single rod extending transversely to the contact bridge. This arrangement of the springs is symmetrical, on the one hand, with respect to the longitudinal plane of the contact bridge, and, on the other hand, with respect to the rotation axis of the contact bridge, to ensure perfect positioning of the contact bridge in any position. The contact bridge is symmetrical and bears on its edges the two cam surfaces, cooperating with the spring anchoring rods.

The invention is hereinafter described in its preferred application to a molded case circuit breaker of the type described in copending U.S. patent application Ser. No. 07/953,026 filed on Sep. 29, 1992 and incorporated herein by reference, but is is clear that it is applicable to other types of limiting circuit breaker.

BRIEF DESCRIPTION OF THE DRAWINGS

Other advantages and features will become more clearly apparent from the following description of an illustrative embodiment of the invention, given as a non-restrictive example only and represented in the accompanying drawings in which.

DESCRIPTION OF THE PREFERRED EMBODIMENT

Figure 1:
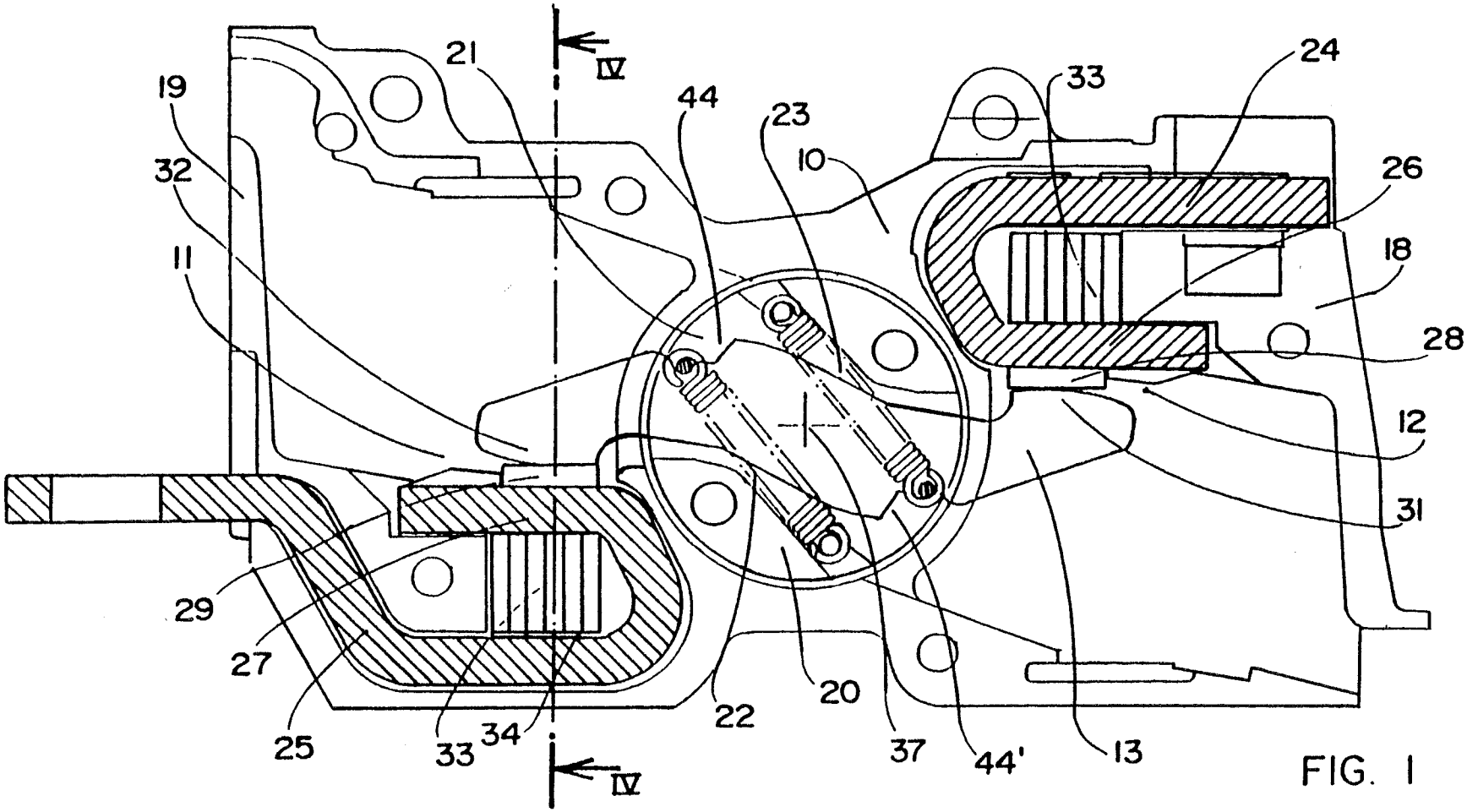
FIG. 1 is a schematic view of the contacts of a pole of a circuit breaker according to the invention, represented in the closed position.
Figure 2:
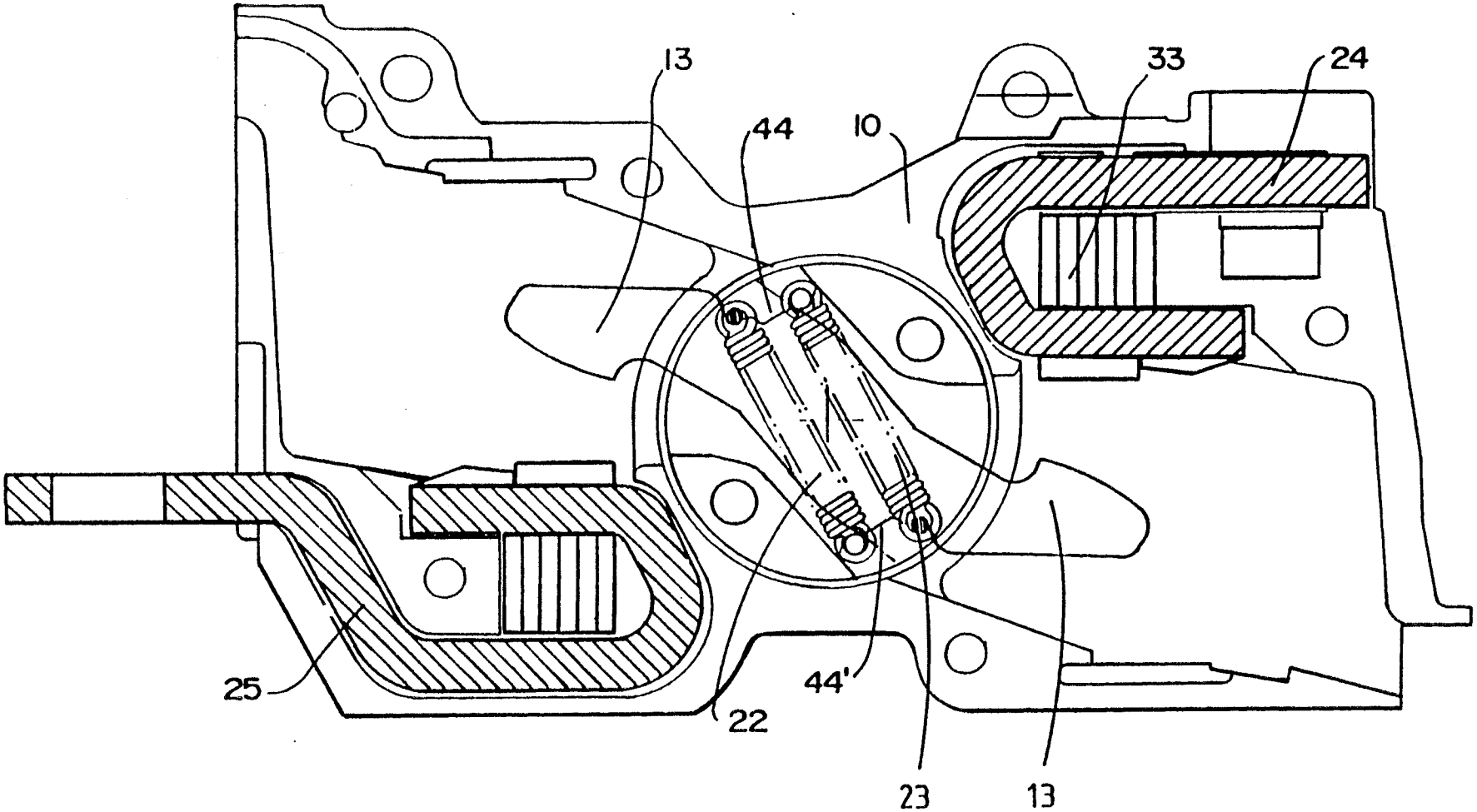
FIG. 2 is a similar view to that of FIG. 1 showing the contacts in the course of opening.
Figure 3:
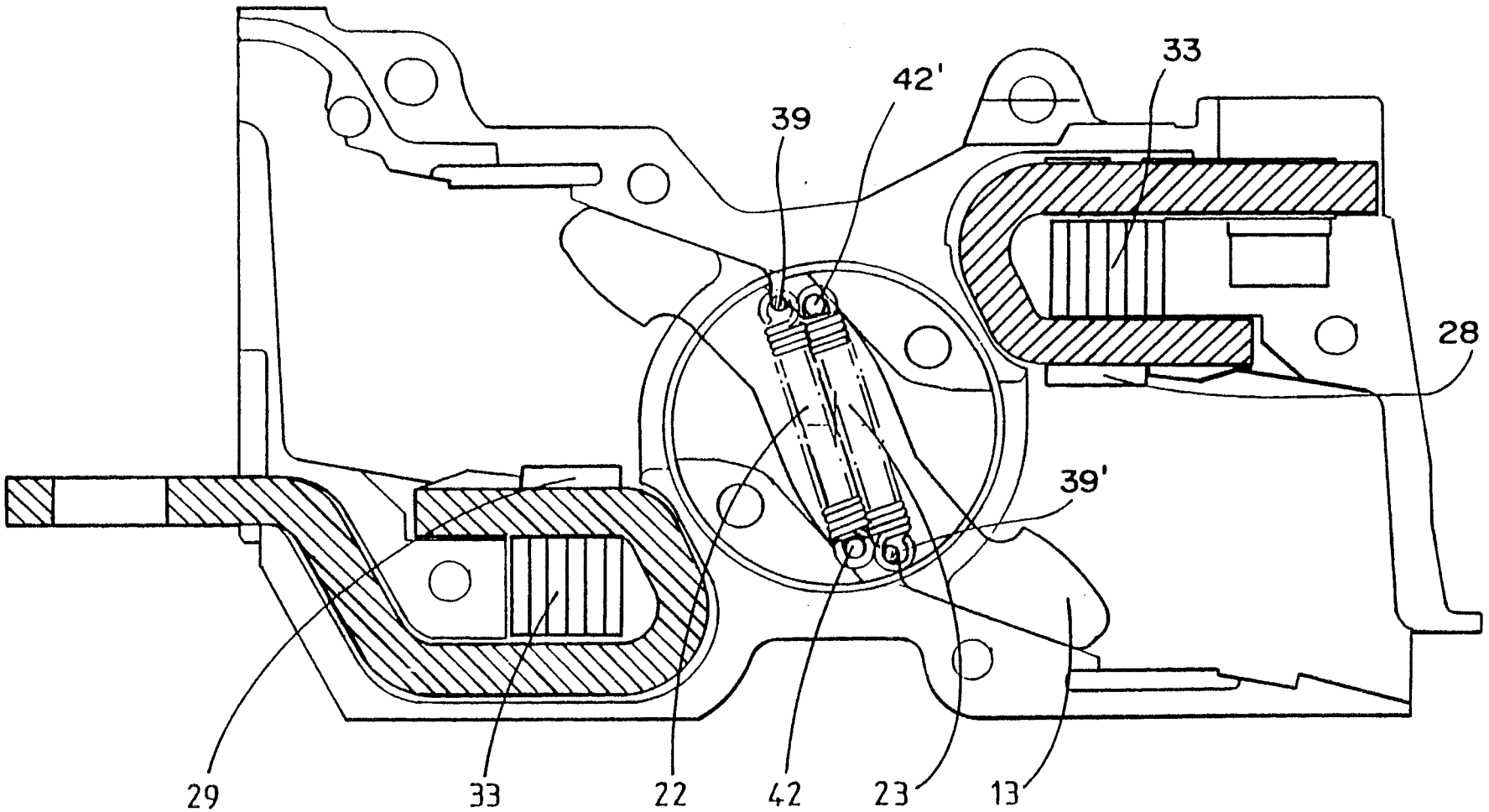
FIG. 3 is a similar view to that of FIG. 1 showing the contacts in the open position.
Figure 4:
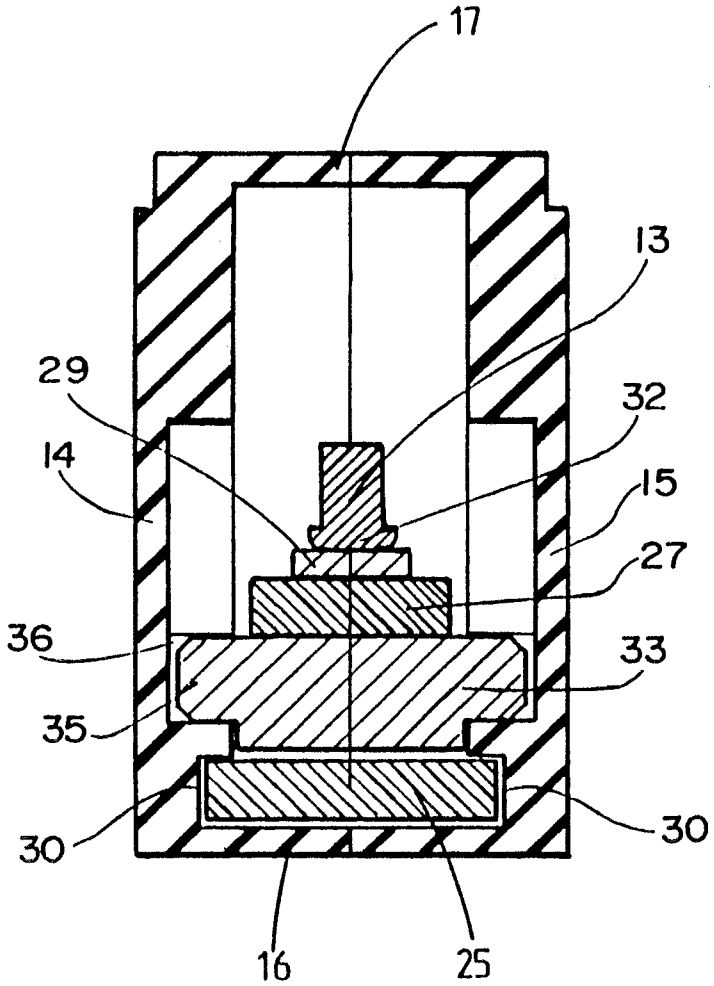
FIG. 4 is a cross-section along the line IV—IV of FIG. 1.

In the drawings, an enclosure 10, made of insulating plastic material, contains the breaking components of a pole of a molded case limiting circuit breaker, including a pair of stationary contacts 11, 12 and a movable contact bridge 13, as well as two extinguishing chambers (not represented). The enclosure 10 of general parallelepipedic shape is formed by two large side faces 14, 15, a base plate 16 and top panel 17, and two small end faces 18, 19. The movable contact bridge 13 is borne by a rotating bar section 20, fitted between the two large side faces 14, 15. The bar section 20 has an orifice 21 extending according to a diameter in a direction parallel to the large side faces and the contact bridge 13 passes through this orifice with clearance protruding out from both sides of the bar section 20. The contact bridge 13 is mounted floating on the bar section 20 by two pairs of springs 22, 23, in the manner described in detail hereinafter. Two current input conductors 24, 25 pass through the small end faces, respectively 18, 19, and are extended inside the enclosure 10 by a curved part in the form of a half-loop whose ends 26, 27 bear the associated stationary contact part 28, 29. In the closed position of the contact bridge 13, the stationary contact part 28 cooperates with the movable contact 31 borne by the contact bridge 13, whereas the stationary contact part 29 cooperates with the movable contact 32. The current input at a given moment via the input conductor 24 flows through the closed contacts 28, 31, contact bridge 13, and closed contacts 32, 29 and is output on the opposite side via the conductor 25. It can be seen that the ends 26, 27 have flowing in them currents of opposite polarities to the currents flowing in the contact bridge 13, thereby generating a repulsion force moving the contact bridge 13 to the open position. This looped trajectory in the zone of the contacts 28, 31; 29, 32 generates a magnetic arc blowout field in the direction of the extinguishing chambers. An operating mechanism (not represented) is coupled to the bar section 20 to control its rotation, and thereby opening and closing of the contacts 28, 31; 29, 32. A circuit breaker of this kind is described in detail in above-mentioned U.S. patent application Ser. No. 07/953,026 which should be advantageously referred to for further details.

The parts of the current input conductors 24, 25, internal to the enclosure 10, are appreciably symmetrical and only the arrangement of input conductor 25 is described in detail below, that of input conductor 24 being identical. The input conductor 25 adjoining the base plate 16 is engaged laterally in the notches 30 provided in the two large side faces 14, 15. The width of the flat conductor 25 is reduced in the curved zone and at its end 27, providing a clearance between the conductor and the large side faces 14, 15. An anvil 33 is fitted between the two branches of the half-loop of the conductor 25, being adjoined to the face of the end 27 opposite to that bearing the stationary contact 29. The anvil 33 is rigidly secured to the enclosure 10 by its ends 35, engaged in grooves 36 arranged in the large side faces 14, 15. The anvil 33 is separated from the other branch of the conductor 25 by an air-gap 34 and the metal block is laminated to limit the Foucault currents generated in the block 33. It can be understood that when the contact bridge 13 closes, the movable contact 32 strikes the stationary contact 29 and the impact is transmitted to the anvil 33 which prevents any bouncing of the stationary contact 29 and amplifies the blow on the stationary contact 29. This blow causes a crushing of the surfaces in contact and a reduction of the contact resistance, which does not present any dispersion. The metal block 33 is made of ferromagnetic material increasing the magnetic field generated by the current flow in the input conductor 25, to blow the arc out in the direction of the extinguishing chamber. The air-gap 34 prevents any short-circuiting of the half-loop but it is clear that an additional insulation can be provided.

Figure 5:
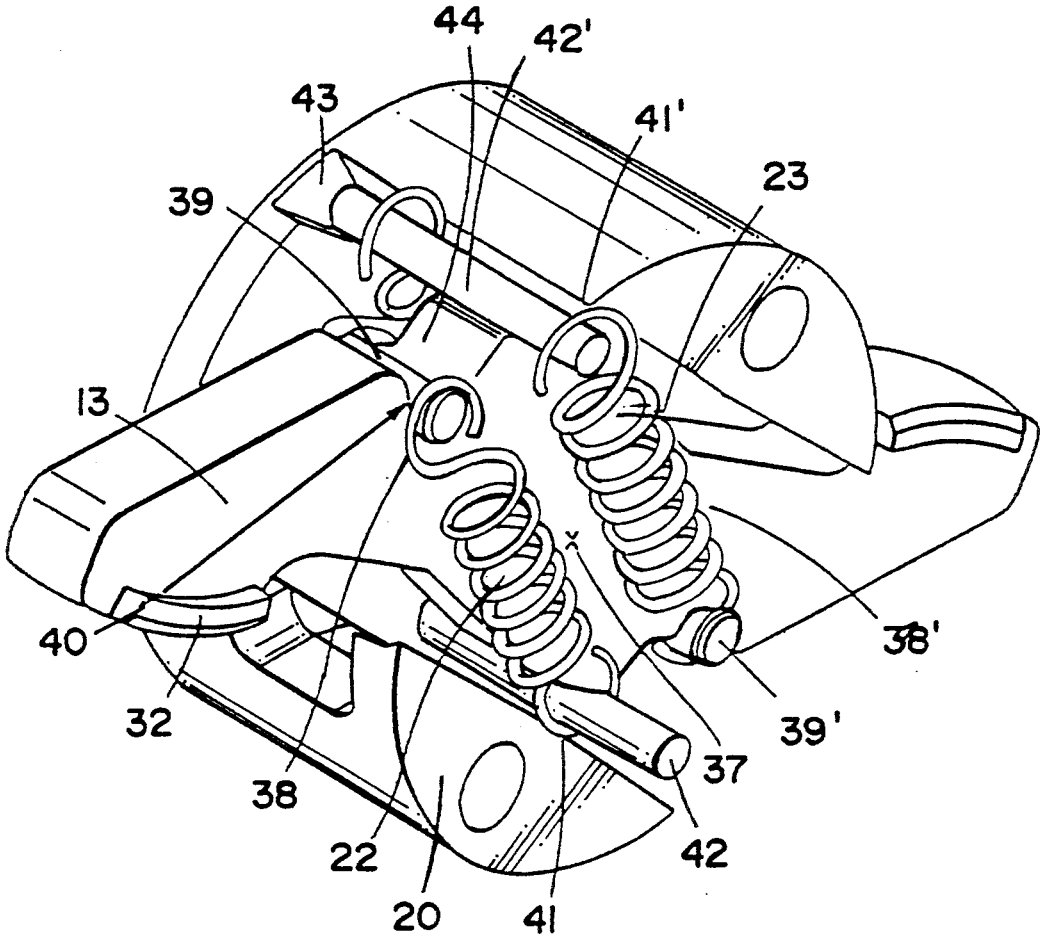
FIG. 5 is a detailed perspective view showing the movable contact bridge and operating bar.

Referring more particularly now to FIG. 5, it can be seen that the springs of the pairs of springs 22, 23 are arranged symmetrically on each side of the contact bridge 13, framing the latter. In addition, the two pairs of springs 22, 23 are located symmetrically with respect to the axis of rotation 37 of the contact bridge 13. One of the ends 38 of the springs 22 is anchored on a spindle 39 extending parallel to the axis 37 and taking its bearing in a notch 40 arranged on the face of the contact bridge 13, opposite from that bearing the movable contact 32. The other end 41 of the tension springs 22 is anchored on a rod 42 slidingly mounted in a notch 43 arranged in the bar 20. The tension springs 22 urge the rod 42 towards the bottom of the notches 43 and exert via the spindle 39 a torque on the contact bridge 13 tending to make the latter pivot in the closing direction. The springs 23 are arranged in the same way, and the same reference numbers assigned with an index are used to designate the corresponding parts. The two pairs of springs 22, 23 provide a floating assembly of the contact bridge 13 in the orifice 21 allowing rotation of the contact bridge 13 around the axis 37. A floating assembly of this kind is described in U.S. Pat. No. 4,910,485 incorporated herein by reference. The pairs of springs 22, 23 also provide the contact pressure in the closed position of the pole. The pairs of springs 22, 23 are arranged symmetrically with respect to the axis 37, so as to exert in any position of the contact bridge 13, a return torque of the contact bridge 13 to the closed position. This torque decreases as the contact bridge 13 moves to the open position, and the anchoring rods 42, 42' are located in such a way as to interfere with the pivoting trajectory of the contact bridge 13, at the end of opening travel by repulsion of the contact bridge 13. For this purpose, the edges of the contact bridge 13 bear or are shaped as a cam surface 44, 44' respectively engaging the rods 42, 42' at the end of repulsion travel, making them slide in their notch 43, in the elongation direction of the springs 22, 23. This engagement slows down the movement of the contact bridge 13, and reduces or cancels the impact on the end of opening travel stop, for example formed or arranged on the enclosure 10. The profile of the cams 44, 44'0 is naturally determined to obtain a progressive deceleration of the contact bridge 13 and it can be arranged to preserve in any position a return torque of the contact bridge to the closed position, or inversely present a catch retaining the contact bridge 13 in the repelled open position. In the former case, the contact bridge 13 closes automatically if opening of the circuit breaker is not confirmed by rotation of the bar section 20 controlled by the mechanism, but the two-way travel of the contact bridge 13 is slowed down by its slowing-down at the end of travel. This slowing-down can be sufficient to provide zone selective tripping, i.e. opening of a load-side switchgear device which clears the fault. In the latter case where the contact bridge 13 is retained in the repelled position, this catching is released when the bar section 20 rotates, actuated by the mechanism, so as to move the contact bridge 13 back to the initial position with respect to the bar 20. It can easily be seen that the slowing-down and/or retaining system of the contact bridge 13, in the repelled position, does not require any additional parts, and is particularly simple and efficient.

The invention is naturally in no way limited to the embodiment more particularly described herein.

We claim:

1. A molded case low voltage circuit breaker comprising: a rotary contact bridge having a rotation axis; a pair of stationary contacts cooperating with said contact bridge each stationary contact of said pair of contacts having a current input conductor connected thereto, each conductor being arranged to generate electrodynamic forces repelling the contact bridge to a repelled open position in response to a short-circuit current; a rotary bar having a transverse orifice housing with clearance said contact bridge which protrudes out from opposite sides of the bar; a pair of rods mounted in notches in said bar; at least one pair of tension springs fitted between the bar and the contact bridge to provide a contact pressure of the contact bridge on the stationary contacts in a closed position of the circuit breaker, wherein at least one pair of tension springs allows rotation of the contact bridge due to said electrodynamic forces to the repelled open position, said springs being arranged symmetrically on each side of the rotation axis of the contact bridge, each of said springs having one end anchored on the contact bridge and an opposite end anchored on one of said rods; and said contact bridge has a pair of cams arranged symmetrically with respect to said rotation axis, each cam arranged to cooperate with one of the pair of rods to slow down the movement of the contact bridge as said contact bridge approaches said repelled open position.

2. The circuit breaker according to claim 1, wherein each of said pair of rods is mounted with limited sliding in a notch arranged in the bar, said notches are arranged on diametrically opposite sides of said bar.

3. The circuit breaker according to claim 1, wherein said springs position the contact bridge flexibly in the orifice of the bar defining a fictitious rotation axis of the contact bridge with respect to the bar.

4. The circuit breaker according to claim 1, wherein the cam has a profile and imposes a movement of the rod in the notch and a progressive elongation of the corresponding tension spring in the course of pivoting of the contact bridge to the repelled position with storing of energy in the spring.

5. The circuit breaker according to claim 1, wherein the cam has a profile and is arranged to generate a latching force of the contact bridge in the repelled position.

6. The circuit breaker according to claim 5, wherein the profile of the cam is arranged to generate catching of the contact bridge in the repelled position.

7. The circuit breaker according to claim 5, wherein the bar is mounted for rotation and is adapted to be actuated by a circuit breaker opening mechanism and the opening travel of the contact bridge is limited so that rotation of the bar releases the rod from an associated cam in the course of the opening travel.

8. The circuit breaker according to claim 1, wherein in the course of pivoting of the contact bridge to the repelled position, a line of action of each spring moves reducing the lever arm and thereby the return torque exerted by the spring on the contact bridge.

9. The circuit breaker according to claim 1, wherein said pair of springs is arranged laterally on one side of the contact bridge and a second pair of springs is arranged symmetrically on another side of the contact bridge and wherein each of said rods is a transverse spindle having opposite ends such that said opposite ends act as anchoring points for the springs.

10. The circuit breaker according to claim 9, wherein said cam is arranged on an edge of the contact bridge opposite from a contact to engage a center section of said transverse spindle as said contact bridge approaches said repelled open position.

* * * * *